US007207559B2

(12) United States Patent
Mizuta et al.

(10) Patent No.: US 7,207,559 B2
(45) Date of Patent: Apr. 24, 2007

(54) SHEET TREATING APPARATUS

(75) Inventors: Yoshimi Mizuta, Chiba (JP); Yoshinori Isobe, Ibaraki (JP); Masaharu Nemura, Ibaraki (JP); Mitsushige Murata, Chiba (JP); Takayuki Okada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 323 days.

(21) Appl. No.: 10/628,430

(22) Filed: Jul. 29, 2003

(65) Prior Publication Data

US 2004/0021266 A1 Feb. 5, 2004

(30) Foreign Application Priority Data

Aug. 1, 2002 (JP) ..... 2002-225143

(51) Int. Cl.
*B65H 31/00* (2006.01)

(52) U.S. Cl. ..... 271/207; 270/58.12; 270/58.08; 270/58.11

(58) Field of Classification Search ..... 271/207, 271/220, 241; 270/58.12, 58.11, 58.08, 58.07
See application file for complete search history.

(56) References Cited

U.S. PATENT DOCUMENTS

| | | | | |
|---|---|---|---|---|
| 5,225,852 | A | 7/1993 | Uchida et al. | 346/134 |
| 5,274,399 | A | 12/1993 | Uchida et al. | 346/134 |
| 5,291,256 | A | 3/1994 | Kitajima et al. | 355/290 |
| 5,351,112 | A | 9/1994 | Naito et al. | 355/233 |
| 5,563,698 | A | 10/1996 | Okada | 355/309 |
| 5,579,083 | A | 11/1996 | Naito et al. | 355/50 |
| 5,761,600 | A | 6/1998 | Murata | 399/403 |
| 5,819,151 | A | 10/1998 | Naito et al. | 399/367 |
| 5,915,159 | A | 6/1999 | Okada | 399/371 |
| 6,120,020 | A * | 9/2000 | Asao | 271/189 |
| 6,142,461 | A * | 11/2000 | Asao et al. | 270/58.09 |
| 6,219,503 | B1 | 4/2001 | Miyake et al. | 399/85 |
| 6,220,592 | B1 * | 4/2001 | Watanabe et al. | 271/241 |
| 6,290,220 | B1 * | 9/2001 | Takehara et al. | 270/58.12 |
| 6,330,422 | B1 | 12/2001 | Sato et al. | 399/382 |
| 6,353,726 | B1 | 3/2002 | Murata et al. | 399/407 |
| 6,371,471 | B1 * | 4/2002 | Fukazu et al. | 270/58.09 |
| 6,371,472 | B1 | 4/2002 | Miyake et al. | 270/58.14 |
| 6,386,080 | B1 | 5/2002 | Okamoto et al. | 83/73 |
| 6,398,203 | B1 * | 6/2002 | Saito et al. | 270/58.12 |
| 6,398,214 | B1 | 6/2002 | Moteki et al. | 271/220 |
| 6,450,934 | B1 * | 9/2002 | Coombs | 493/383 |

(Continued)

FOREIGN PATENT DOCUMENTS

JP 6-234453 * 8/1994

*Primary Examiner*—Patrick Mackey
*Assistant Examiner*—Thomas Morrison
(74) *Attorney, Agent, or Firm*—Fitzpatrick, Cella, Harper & Scinto

(57) ABSTRACT

A sheet treating apparatus to be connected to an image forming apparatus, which has a sheet guide portion which selectively guides a sheet to a sheet stacking portion or a sheet treating portion and, in a state in which a power supply of the sheet treating apparatus is turned off, the sheet guide portion guides a sheet to the sheet stacking portion such that a sheet delivered from the image forming apparatus can be stacked even if the power supply of the sheet treating apparatus is turned off. Moreover, a sheet can be stacked on the sheet stacking portion without using a transporting drive force of the sheet treating apparatus.

7 Claims, 9 Drawing Sheets

U.S. PATENT DOCUMENTS 6,471,429 B1 10/2002 Isobe et al. ..... 400/582
6,575,446 B2 * 6/2003 Wakabayashi et al. ... 270/58.07
6,601,840 B2 * 8/2003 Boss et al. ..... 270/58.08
6,603,951 B2 8/2003 Sato et al. ..... 399/382
6,685,180 B2 * 2/2004 Saegusa et al. ..... 270/58.08
2002/0060388 A1 * 5/2002 Wakabayashi et al. ... 270/58.08
2002/0129690 A1 9/2002 Yaginuma et al. ..... 83/628
2002/0163119 A1 * 11/2002 Kawata ..... 271/207
2003/0049063 A1 3/2003 Suzuki et al. ..... 399/407

* cited by examiner

SHEET TREATING APPARATUS

BACKGROUND OF THE INVENTION

1. Field of the Invention

The present invention relates to a sheet treating apparatus for subjecting a sheet to treatment.

2. Related Background Art

In recent years, a sheet treating apparatus has been widely used as its advantage of extremely improving handling property of a sheet was recognized. The sheet treating apparatus subjects a sheet to at least one of sheet aligning treatment, sheet punching treatment, sheet binding treatment, sheet folding treatment, and the like.

A conventional sheet treating apparatus is a so-called "finisher", which is connected to, for example, an image forming apparatus and subjects a sheet, on which an image is formed by the image forming apparatus, to the above-mentioned treatment. Examples of the image forming apparatus include a copying machine, a printer, a facsimile, and a multi-function apparatus thereof.

By the way, in the case in which a sheet treating apparatus is connected to, for example, an image forming apparatus and used, it is not always necessary to subject all sheets, on which images are formed by the image forming apparatus, to post-treatment.

However, conventionally, all the sheets having images formed thereon are transported to a sheet stacking portion by a driving force of a transporting roller or the like in the sheet treating apparatus, so that electric power is always consumed even if the sheets are not subjected to post-treatment.

In addition, in a structure in which all sheets pass through a sheet treating portion, an initialization operation of the sheet treating portion is performed or each transporting roller is rotated in the same manner as subjecting the sheets to post-treatment. Consequently, the conventional sheet treating apparatus wastes electric power. Moreover, if a sheet which is not required to be subjected to treatment is caused to pass through the sheet treating portion, the sheet may be smeared.

Further, in the conventional sheet treating apparatus, even a sheet which is not required to be subjected to the post-treatment passes through the sheet treating portion. Accordingly, components of the sheet treating portion operate unnecessarily. As a result, a useful life of the components is reduced. In addition, unnecessary operation results in increase of causes of failure.

SUMMARY OF THE INVENTION

It is an object of the present invention to provide a sheet treating apparatus which eliminates waste of power consumption in the sheet treating apparatus in the case in which a sheet which is not required to be subjected to post-treatment is transported to the sheet treating apparatus.

It is another object of the present invention to provide a sheet treating apparatus which eliminates waste of power consumption by directly delivering a sheet without passing it through a mechanism for subjecting the sheet to treatment.

It is yet another object of the present invention to provide a sheet treating apparatus which prevents a decrease in a useful life.

Other objects of the present invention will be apparent from descriptions based upon the accompanying drawings and appended claims.

DESCRIPTION OF THE PREFERRED EMBODIMENTS

Embodiments of the present invention will be hereinafter described in detail with reference to the accompanying drawings.

(Schematic Structure of a Copying Machine)

Figure 1:
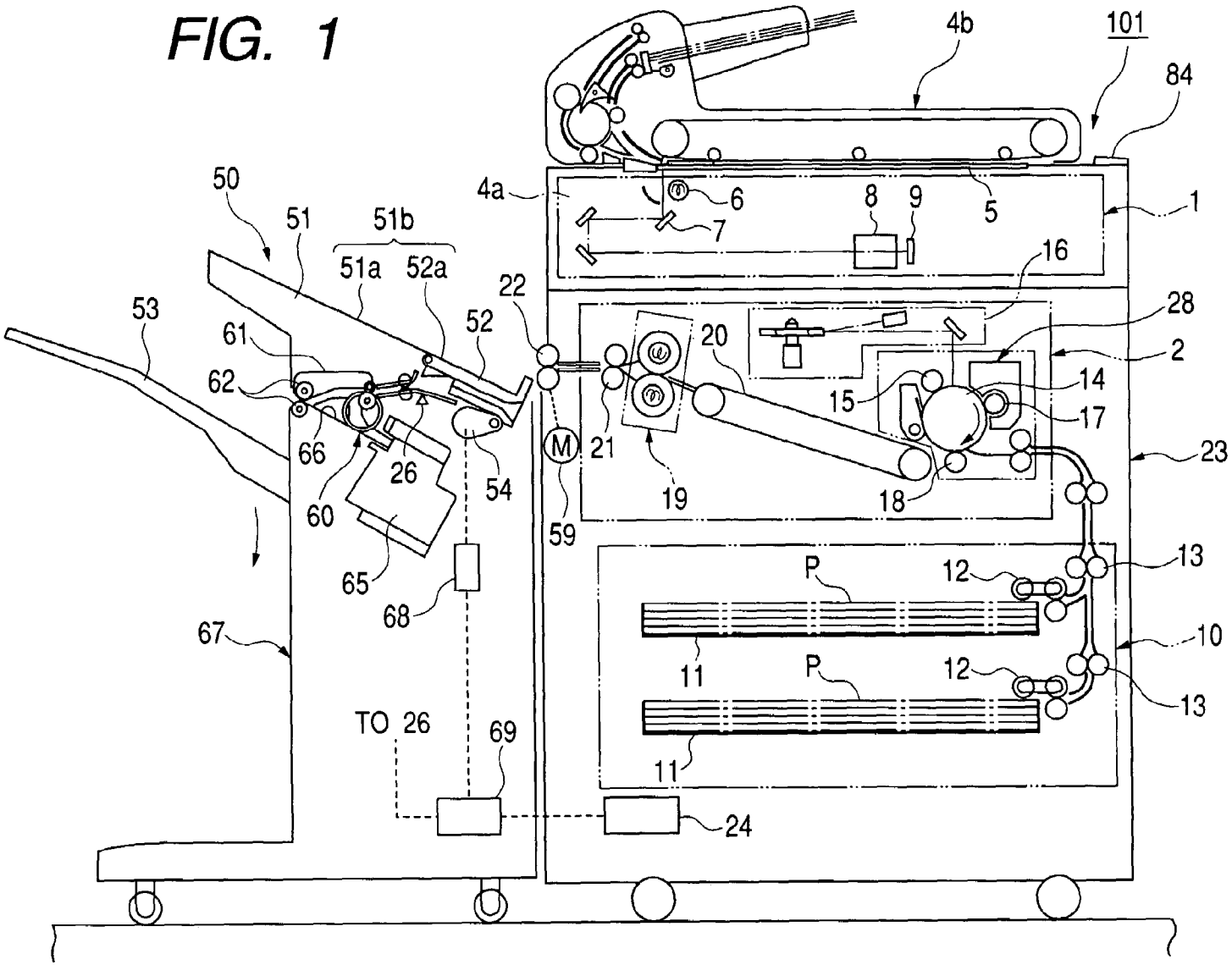
FIG. 1 is a sectional view along a sheet transporting direction of a copying machine which is an example of an image forming apparatus provided with a sheet treating apparatus of a first embodiment of the present invention.

FIG. 1 is a schematic sectional view of an image forming apparatus connected with a sheet treating apparatus to which the present invention can be applied. In this embodiment, an apparatus main body 67 of a sheet treating apparatus 50 and an apparatus main body 23 of an image forming portion 2 or the like are separately provided. Then, a sheet treatment control portion 69, which controls the sheet treating apparatus 50, is provided in the apparatus main body 67 of the sheet treating apparatus 50. An image formation control portion 24, which controls a charging roller 15, a photosensitive drum 14, and the like, is provided in the apparatus main body 23 of the image forming portion 2 or the like.

Figure 4:
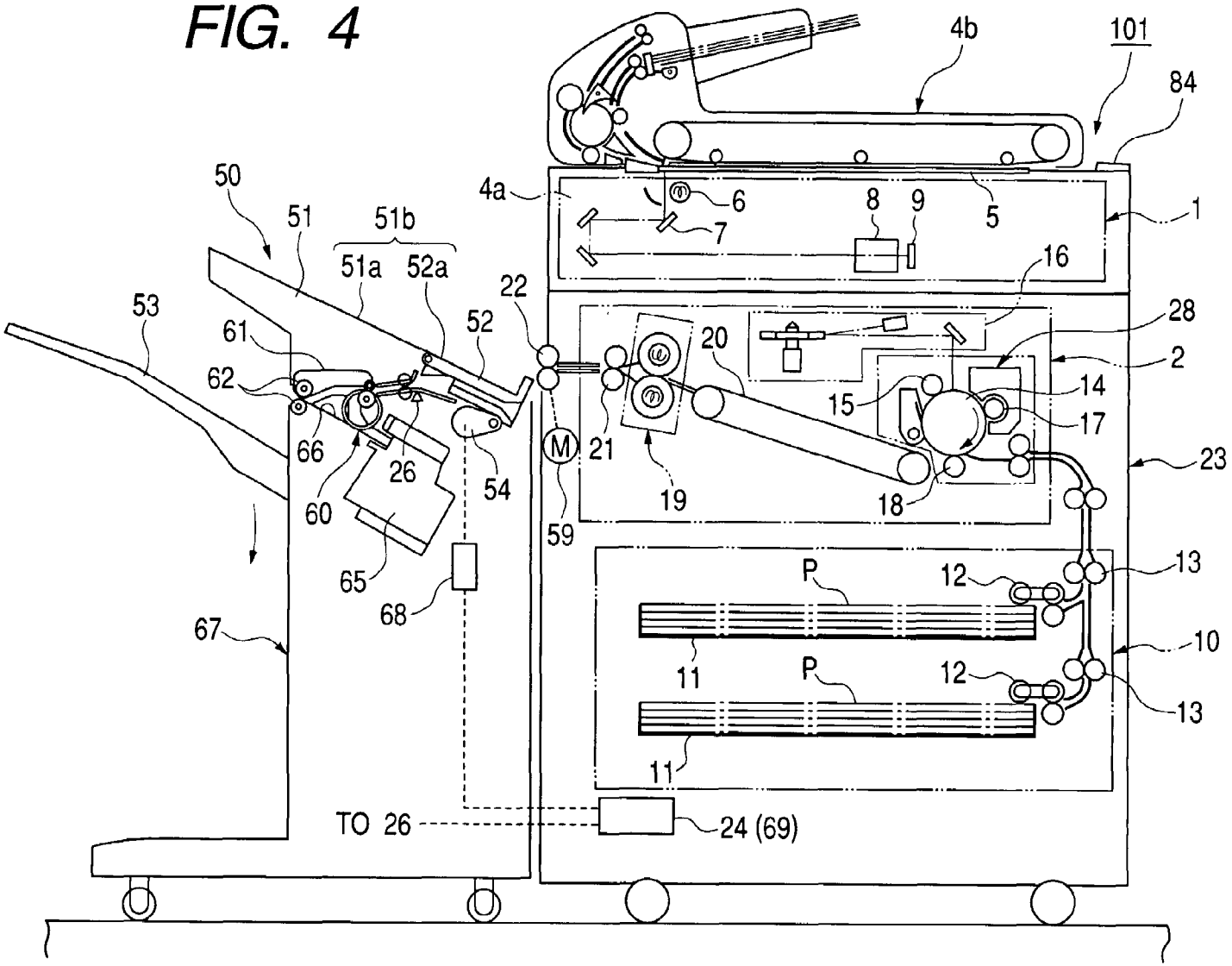
FIG. 4 is a view in which an image formation control portion and a sheet treatment control portion are integrated in the copying machine shown in FIG. 1.
Figure 5:
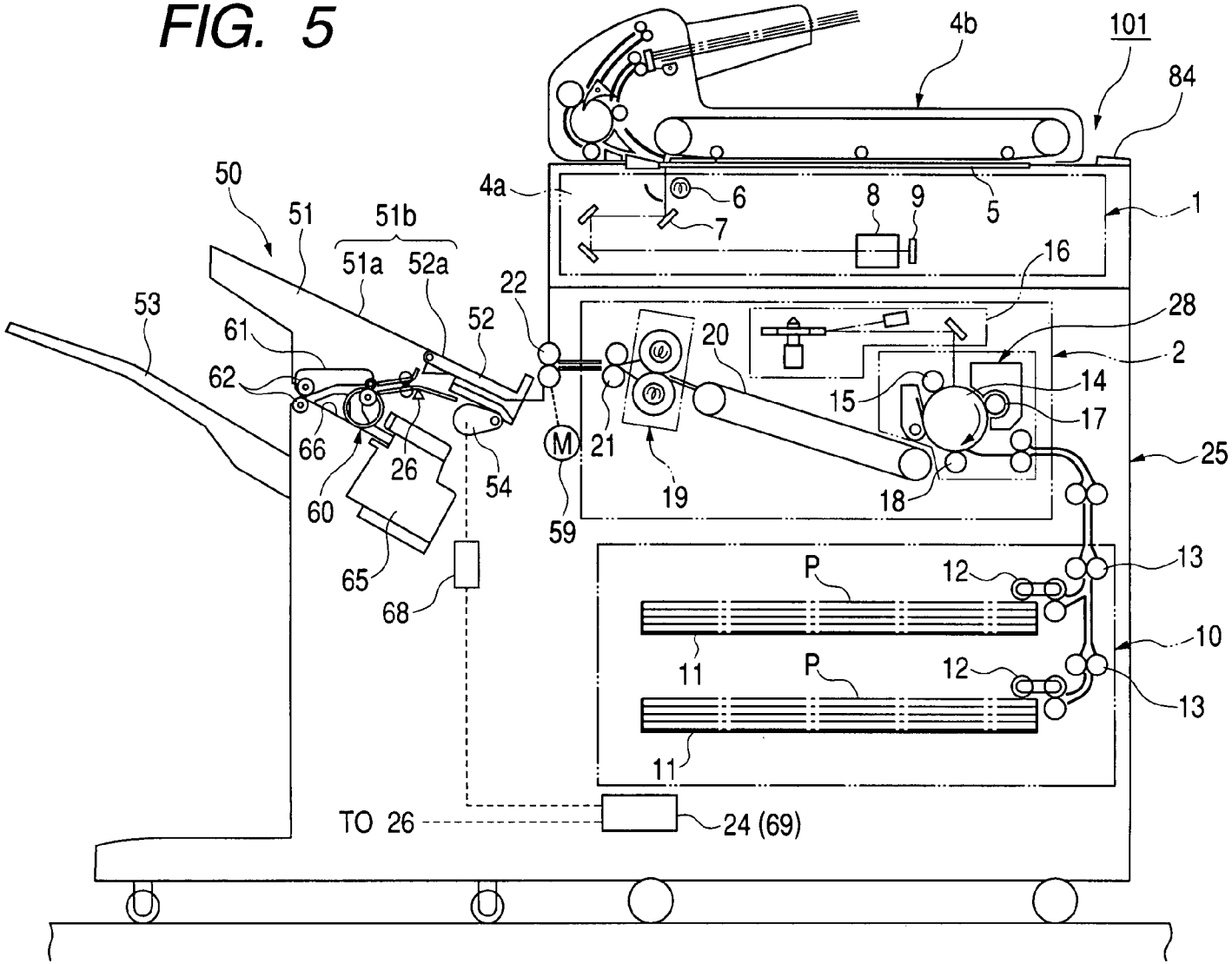
FIG. 5 is a view in which the image formation control portion and a sheet treatment control portion are integrated and an apparatus main body of the sheet treating apparatus and an apparatus main body of an image forming portion or the like are integrated in the copying machine shown in FIG. 1.

Note that, as shown in FIG. 4, the sheet treatment control portion 69 may be integrated with the image formation control portion 24. Alternatively, although not illustrated, the image formation control portion 24 may be integrated with the sheet treatment control portion 69. Moreover, as shown in FIG. 5, the sheet treating apparatus 50 and the image forming portion 2 or the like may have a common apparatus main body 25, and the sheet treatment control portion 69 may be integrated with the image formation control portion 24. Although a power supply switch 84 is provided in the apparatus main body 23 in FIG. 1 and FIG. 4, it may be provided in the apparatus main body 67 of the sheet treating apparatus 50.

A copying machine 101 includes: an image reading portion 1 which reads an image on an original; an image forming portion 2 which forms an image on a sheet; a sheet supplying portion 10 which supplies a sheet to the image forming portion 2; the sheet treating apparatus 50; the image formation control portion 24 which controls the image forming portion 2 or the like; the sheet treatment control portion 69 which controls the sheet treating apparatus 50, and the like.

The image reading portion 1, the image forming portion 2, the sheet supplying portion 10, and the image formation control portion 24 are provided in the apparatus main body 23. The image reading portion 1 is arranged above the image forming portion 2. The sheet treating apparatus 50 which, for example, binds sheets, on which images are formed in the image forming portion 2, is arranged on the left of the image forming portion 2.

(Image Reading Portion)

The image reading portion 1 has an original transporting device (ADF) 4*b* on a platen glass plate 5 on which an original is mounted. The image reading portion 1 reads an original, which is transported onto the platen glass plate 5 from the original transporting device 4*b*, or an original, which is directly set on the platen glass plate 5 with the original transporting device 4*b* opened, by subjecting it to exposure scanning with a scanning optical system 4*a*.

That is, the image reading portion 1 irradiates light on the original on the platen glass plate 5 while scanning it with a light source 6, and condenses reflected light from the original to a photoelectric conversion element 9 via mirrors 7 and a lens 8 to convert the reflected light into an electrical digital signal or transmit it to an image forming portion of another image forming apparatus or a facsimile apparatus. The copying machine 101 functions as a copy machine if it transmits this digital signal to the image forming portion 2 of its own and functions as a facsimile apparatus if it transmits this digital signal to an image forming portion of another copying machine or an image forming portion of a facsimile apparatus.

Note that it is not always necessary to provide the original transporting device 4*b* in the image reading portion 1. That is, the image reading portion 1 may be provided with an original pressing member which presses an original set on the platen glass plate 5 of the scanning optical system 4*a*.

(Image Forming Portion)

The image forming portion 2 forms a toner image on a sheet P, which is transported by a feeding roller 12 and a transporting roller pair 13 from a sheet cassette 11 inserted in a sheet supplying portion 10 arranged below the image forming portion 2, with an electrophotographic process. That is, a surface of the photosensitive drum 14 rotating in a direction indicated by the arrow in FIG. 1 is uniformly charged by the charging roller 15 and exposed by a laser scanner 16 which irradiates light based upon image information transmitted from the image reading portion 1, a personal computer, or the like as described above, so that a latent image is formed on the surface.

This latent image is visualized by toner development performed by a developing device 17. Then, a toner image is transferred onto the transported sheet P by application of bias to a transfer roller 18. The sheet having the toner image transferred thereon is transported to a fixing device 19 by a transport belt 20 and heated and pressurized by the fixing device 19 to have the toner image fixed thereon. Finally, the sheet is transported by a transporting roller pair 21 and delivered to the sheet treating apparatus 50 by a delivery roller pair 22.

An image formation treating portion 28 provided in the apparatus main body 23 of the copying machine 101 is controlled by the image formation control portion 24. The image formation treating portion 28 includes the charging roller 15, the developing device 17, the photosensitive drum 14, and the like. The image formation control portion 24 also controls the image reading portion 1, the image forming portion 2, the sheet supplying portion 10, and the like.

(Sheet Treating Apparatus of a First Embodiment)

Figure 2:
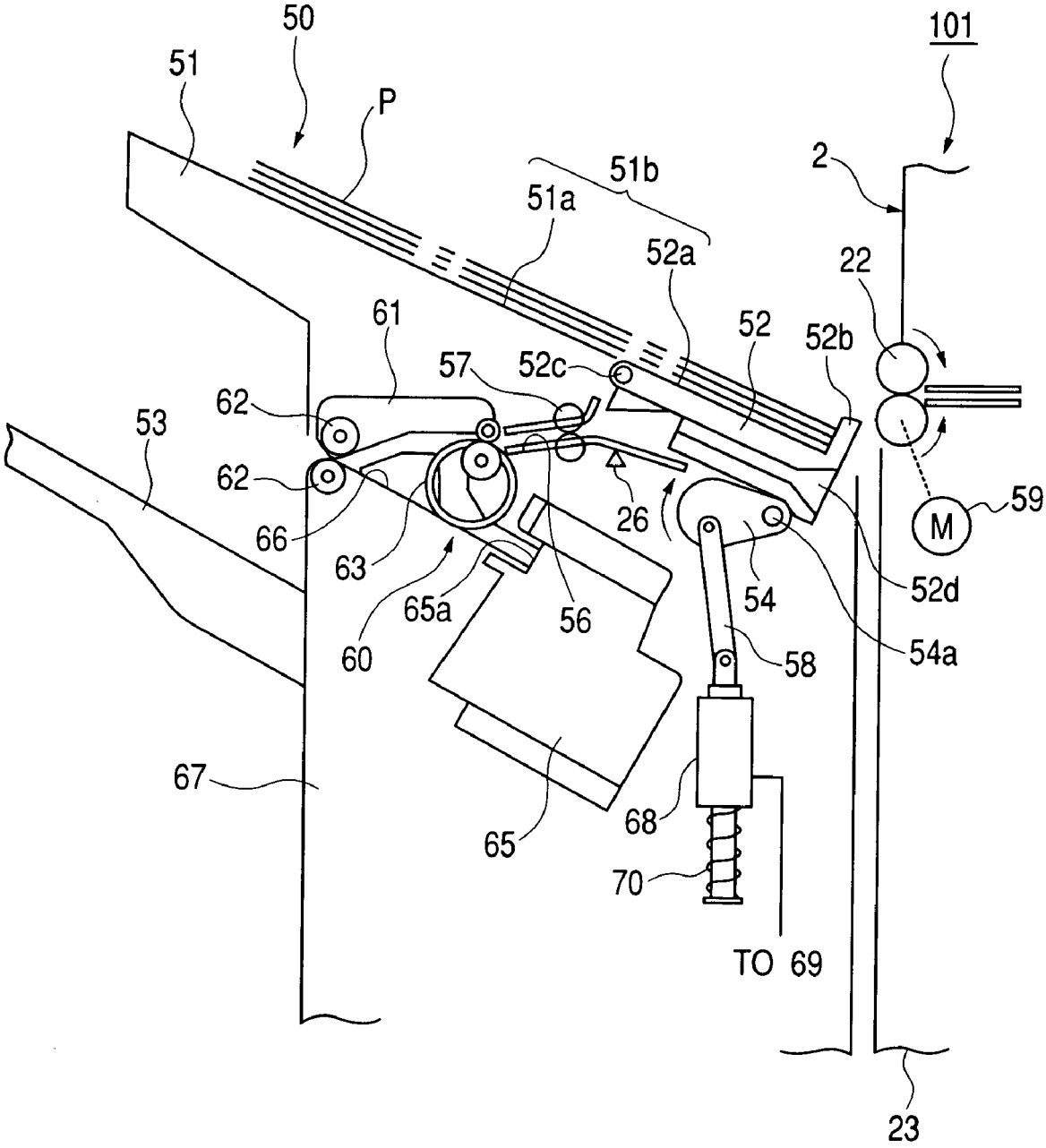
FIG. 2 is a view for explaining operations at the time when the sheet treating apparatus shown in FIG. 1 receives a sheet which is not required to be subjected to treatment in a fixed tray.
Figure 3:
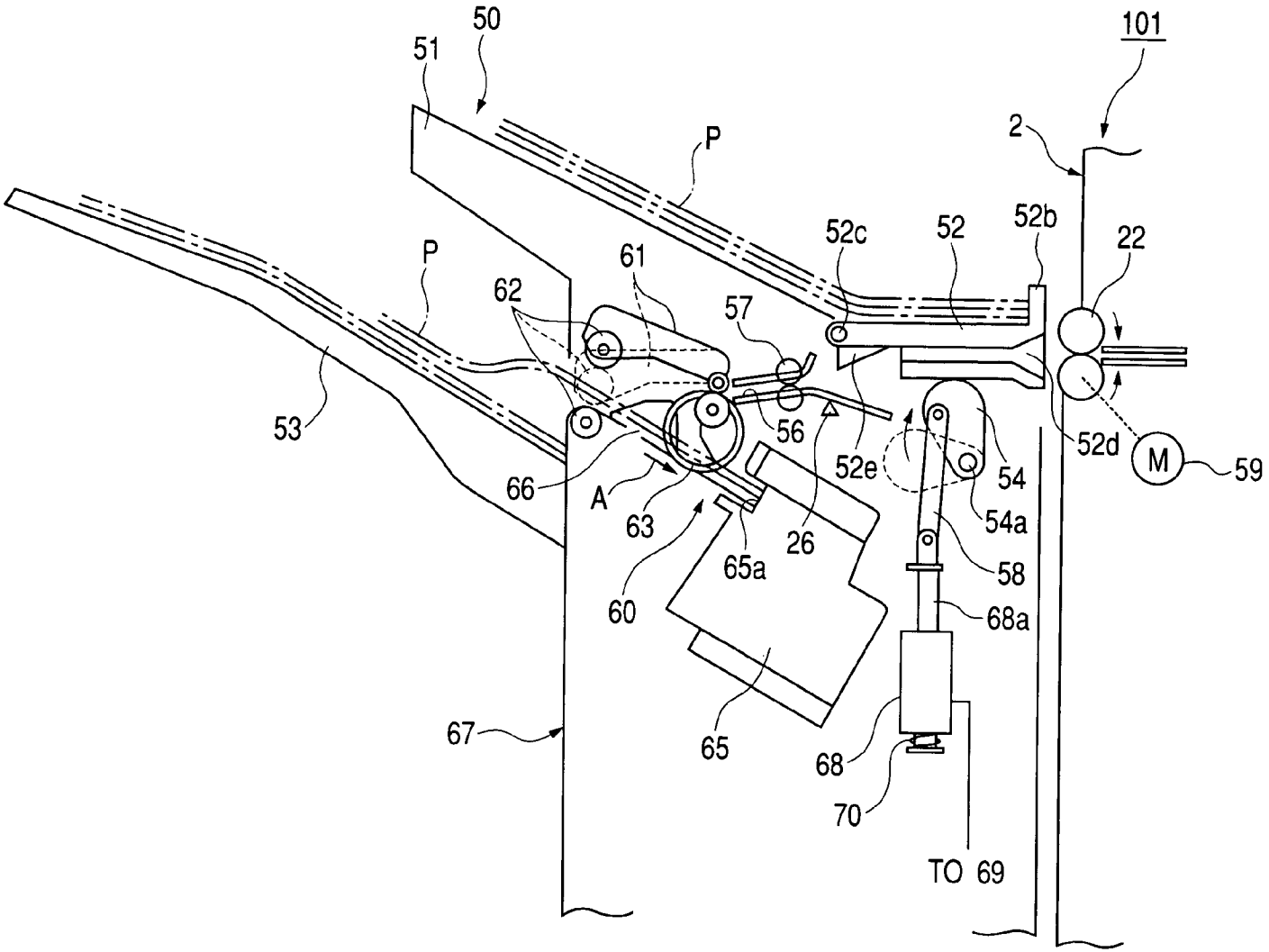
FIG. 3 is a view for explaining operations at the time when the sheet treating apparatus shown in FIG. 1 subjects a sheet to treatment.

FIG. 2 is a view showing a state at the time when the sheet P is delivered to a fixed tray 51 serving as sheet stacking means without being subjected to the post-treatment in the sheet treating apparatus of this embodiment. FIG. 3 is a view showing a state at the time when the sheet P is subjected to the post-treatment and delivered to an ascending and descending tray 53 serving as treated sheet stacking means.

First, the sheet treating apparatus 50 will be schematically described. A sheet having an image formed thereon, which has passed the fixing device 19, is selectively delivered by an operation of a pivotable guide 52. That is, the sheet is delivered to the fixed tray 51 in the case in which the sheet is delivered without being subjected to the post-treatment, and delivered to the ascending and descending tray 53 in the case in which the sheet is subjected to the post-treatment and delivered. In addition, in the case in which a large quantity of sheets having images formed thereon are delivered, the sheets are delivered to the ascending and descending tray 53 even if the sheets are not subjected to the post-treatment. The sheet treating apparatus 50 of this embodiment can stack a large volume of sheets because the ascending and descending tray 53 moves in a direction indicated by the arrow (downward) in FIG. 1 according to the number of sheets.

As described above, the pivotable guide 52 selects a tray, on which sheets not subjected to the post-treatment are stacked, in the sheet treating apparatus 50 of this embodiment in advance according to an instruction of an operator. The selection of the tray by the pivotable guide 52 may be performed from an operation panel of the apparatus, a personal computer, or the like for each job, or may be set in advance according to a type of a job, the output number of sheets, or the like.

For example, the sheet treating apparatus 50 of this embodiment can be set so as to automatically select a tray, to which sheets are delivered, according to the output number of sheets set for one job in a print job in which the post-treatment is not set. That is, the sheet treating apparatus 50 of this embodiment delivers sheets to the fixed tray 51 in the case of a job for printing a small number of sheets and delivers the sheets to the ascending and descending tray 53 in the case of a job for printing a large number of sheets.

In addition, the sheet treating apparatus 50 of this embodiment can also perform control to count not only the output number of sheets for each job but also the number of sheets stacked on the fixed tray 51 and, at a point when the number of sheets has reached a predetermined number, switch a delivery destination of the sheets to the ascending and descending tray 53.

A structure of the sheet treating apparatus 50 of this embodiment will be hereinafter described. In FIG. 2, a sheet, on which an image is formed in the image forming portion 2, is delivered to the fixed tray 51 on the apparatus main body 67 of the sheet treating apparatus 50 by the delivery roller pair 22 which is provided in the image forming portion 2 and rotates in a direction indicated by the arrow. That is, sheets are selectively stacked on an upper surface 51*a* of the fixed tray 51 provided on an upper surface of the sheet treating apparatus 50 and an upper surface 52*a* of a pivotable guide 52 as will be described later.

The pivotable guide 52 pivots in a vertical direction around a pivotable shaft 52*c* by pivotal movement of a pivotable cam 54. The pivotable guide 52 is pivotably provided in the apparatus main body 67 of the sheet treating apparatus 50 by the pivotable shaft 52*c*. In the pivotable guide 52, a guide path 52*d* which guides a sheet from the delivery roller pair 22 to a post-treatment portion 60 serving as sheet treatment means is formed. The pivotable guide 52 takes a first position (shown in FIG. 3) in which the sheet guide path 52*d* is opposed to the delivery roller pair 22 and a second position (shown in FIG. 2) in which the upper surface 52*a* of the pivotable guide 52 is opposed to the delivery roller pair 22.

The pivotable cam 54 is coupled to a plunger 68 via a coupling link 58 and is pivoted in a vertical direction around a pin 54*a* by the plunger 68.

Here, operations of the pivotable cam 54 and the pivotable guide 52 will be described. In the case in which a sheet is not required to be subjected to the post-treatment or in the case in which power is not supplied to the sheet treating apparatus, as shown in FIG. 2, the pivotable cam 54 is stopped in a waiting position rotated downward and the pivotable guide 52 is also stopped in a waiting position by a return spring 70 provided in the plunger 68. Therefore, sheets delivered from the image forming apparatus can be stacked on the fixed tray 51 even if power is not supplied to the sheet treating apparatus. On the other hand, in the case in which the sheets are subjected to the post-treatment (power is supplied), when the plunger 68 operates against an elastic force of the return spring 70 according to control of the sheet treatment control portion 69 (see FIG. 1), as shown in FIG. 3, the pivotable cam 54 is pivoted upward to rotate to an actuated position and push up the pivotable guide 52. The state in which the pivotable cam 54 and the pivotable guide 52 are pivoted upward is held by a holding current flowing to the plunger 68.

Therefore, the pivotable cam 54 and the pivotable guide 52 are in the waiting position when an electric current is not flowing to the plunger 68. In addition, when the holding current does not flow to the plunger 68, the pivotable cam 54 returns from the actuated position shown in FIG. 3 to the waiting position shown in FIG. 2 by the return spring 70. In accordance with this, the pivotable guide 52 returns to the waiting position with the aid of its gravitational force. Note that, although the return spring 70 is provided such that the pivotable cam 54 surely returns to the waiting position from the actuated position, the returning spring 70 is not always necessary in the case in which the pivotable cam 54 surely returns to a return position with the aid of the gravitational force of a spindle 68*a* etc., facing the vertical direction of the plunger 68.

Figure 6:
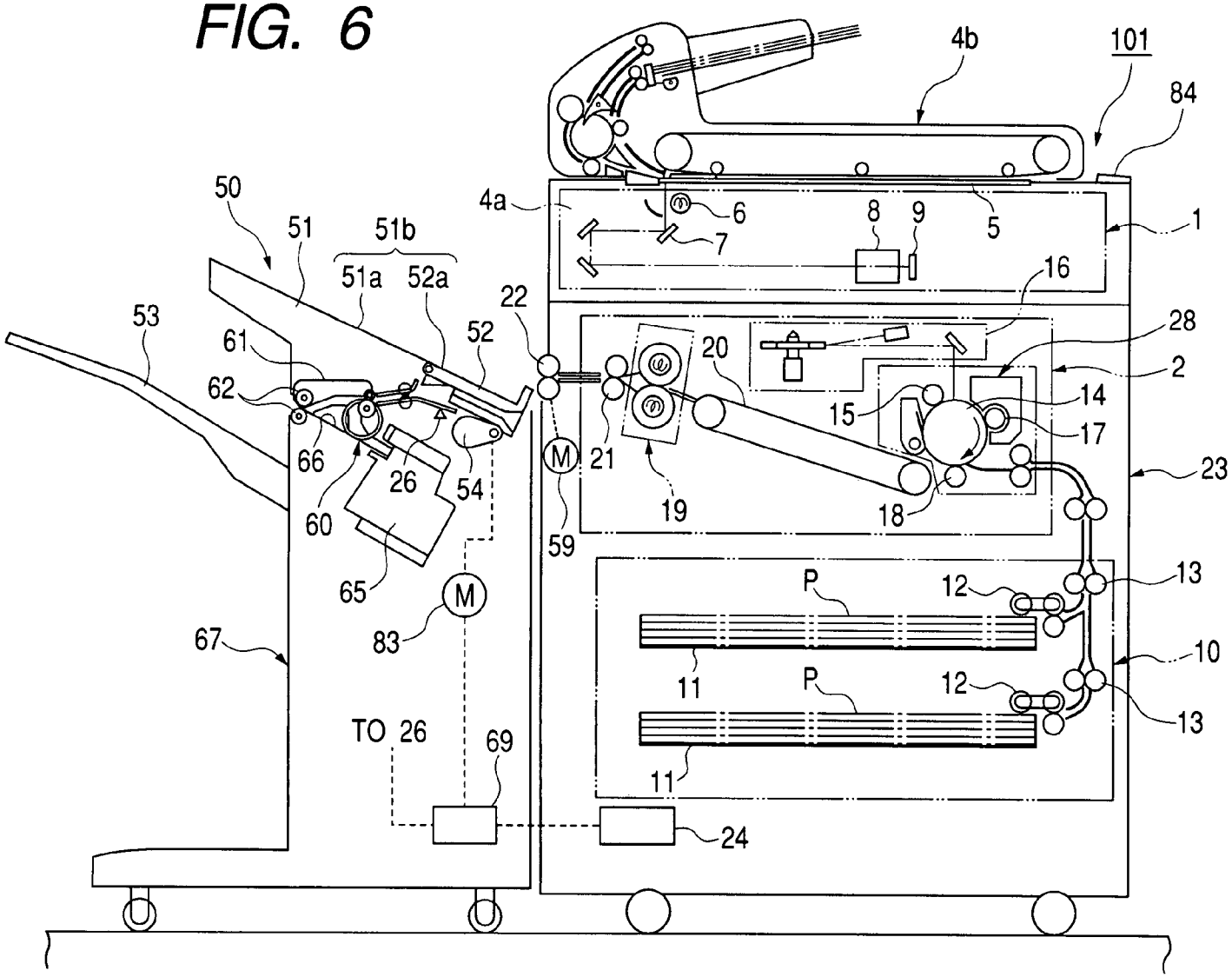
FIG. 6 is a sectional view along a sheet transporting direction of a copying machine in the case in which a pivotable guide is actuated by a motor in the sheet treating apparatus shown in FIG. 1.

As shown in FIG. 6, a motor 83 may be coupled to the pin 54*a* (see FIG. 2) instead of the plunger to pivot the pivotable cam 54 according to rotation of the motor 83. In this case, the pivotable cam 54 pivots to the actuated position shown in FIG. 3 from the waiting position shown in FIG. 2 according to the rotation of the motor 83, held in the actuated position by a locking current flowing to the motor 83, and returns to the waiting position according to a reverse rotation of the motor 83 or release of the locking current and with the aid of gravitational force of the pivotable guide 52.

Moreover, a driving source provided in the apparatus main body 23 of the image forming portion 2 or the like may be used instead of the motor 83. For example, a motor 59 for a delivery roller pair rotating the delivery roller pair 22 may be used. In this case, since the motor 59 rotates the delivery roller pair 22, it is necessary to provide a not-shown clutch between the motor 59 and the pivotable cam 54 such that rotation of the motor 59 is not transmitted to the pivotable cam 54 even when the delivery roller pair 22 is rotated for sheet delivery after the pivotable cam 54 is pivoted. Moreover, it is necessary to prevent the rotation of the pivotable cam 54 by providing a now-shown brake in the clutch or the pivotable cam 54 in order to hold the pivotable cam 54 in a position pivoted upward. The pivotable cam 54 is pivoted downward by releasing the brake and rotating the motor reversely or is pivoted using the gravitational forces of the pivotable guide 52 and the pivotable cam 54.

In addition, the pivotable cam 54 may be actuated directly by any one of the plunger 68, the motor 83, and the motor 59.

Power consumption due to the holding current of the plunger 68, the locking current of the motor 83, and the like is power consumption which never occurs in the conventional sheet treating apparatus. However, the power consumption is smaller than a total power consumption of power consumed for rotation of the transporting roller in the conventional sheet treating apparatus, power consumed for initial operation, and the like. Thus, the power consumption never prevents energy saving of the sheet treating apparatus of this embodiment.

Figure 8:
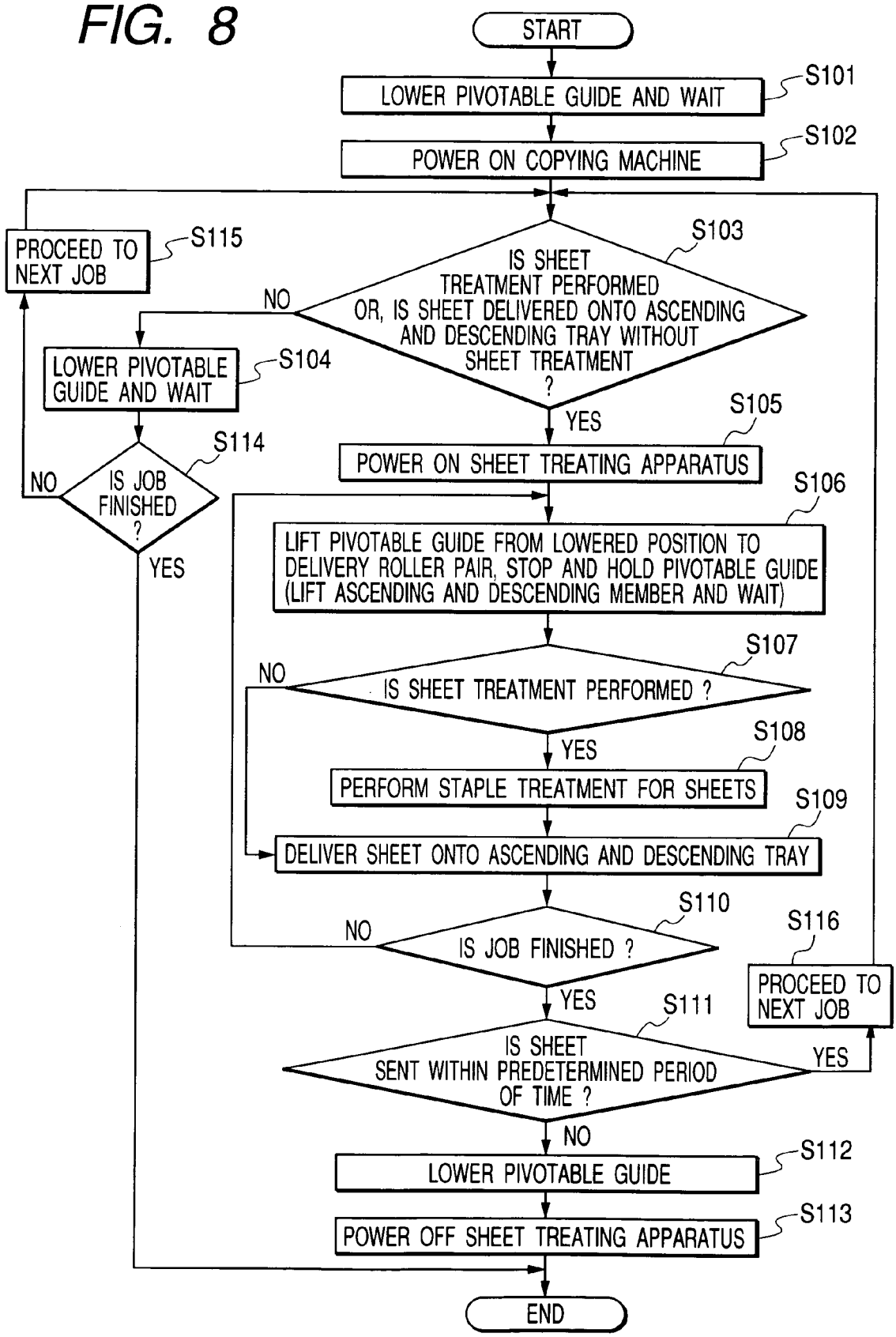
FIG. 8 is a schematic flowchart illustrating operations of the sheet treating apparatus.

An operation mode of the sheet treating apparatus will be hereinafter described with reference to a flowchart of FIG. 8.

(Mode for Stacking Sheets on The Fixed Tray 51).

FIG. 2 shows a state of the sheet treating apparatus 50 at the time when a sheet which is not required to be subjected to the post-treatment is delivered to the fixed tray 51 in the sheet treating apparatus 50 of this embodiment. Usually, the pivotable guide 52 is waiting in the lowered state shown in FIG. 2 (S101 in FIG. 8). Power supply to the copying machine 101 is turned ON (S102). Since a sheet is not subjected to the post-treatment and a sheet is not delivered to the ascending and descending tray 53 (S103), the pivotable guide 52 remains lowered.

A sheet on which an image is formed by the image forming portion 2 is delivered to and stacked on the upper surface 51*a* of the fixed tray 51 and the upper surface 52*a* of the pivotable guide 52 by the delivery roller pair 22. Therefore, power is not supplied to the sheet treating apparatus 50 at all during a job operation for delivering a sheet to the fixed tray 51 without subjecting the sheet to treatment. Sheets are stacked on the fixed tray 51 by a designated recording number from the sheet delivery roller pair 22. If all jobs are not finished, the sheet treating apparatus 50 proceeds to the next job (S114, S115). If the jobs are finished, the sheet treating apparatus 50 stops.

(Mode for Stacking a Large Volume of Sheets on the Ascending and Descending Tray 53 Without Performing Staple Treatment)

When an operator selects a mode for delivering a large volume of sheets to the ascending and descending tray 53 without performing stapling treatment from an operation panel or the like of the image forming apparatus, a signal for the mode is sent from the image formation control portion 24 to the sheet treatment control portion 69, and the sheet treatment control portion 69 controls the power supply of the sheet treating apparatus to be turned ON (S105). Note that the image formation control portion may control the power supply of the sheet treating apparatus to be turned ON.

The sheet treatment control portion 69 actuates the plunger 68 to pivot the pivotable cam 54 in the waiting position shown in FIG. 2 in a direction indicated by the arrow. As shown in FIG. 3, the pivotable guide 52 is pushed by the pivotable cam 54 to pivot upward around the pivotable shaft 52*c* and stops when the sheet guide path 52*d* is opposed to the delivery roller pair 22 (S106). As a result, the pivotable guide 52 pivots from the second position to the first position and comes into a state in which a sheet can be guided into the post-treatment portion 60 from the delivery roller pair 22. Note that a pivoting amount of the pivotable guide 52 pivoting between the second position and the first position is set in advance according to a movement amount of the spindle 68*a* of the plunger 68.

As shown in FIG. 3, the sheet P delivered from the delivery roller pair 22, which rotates in the direction indicated by the arrow, in the image forming portion 2 is guided by the sheet guide path 52*d* and a guide rib 52*e* of the pivotable guide 52 and transported on the sheet guide path 56 by the transporting roller pair 57. Then, the sheet P is delivered to the ascending and descending tray 53 by the delivery roller pair 62 and stacked thereon (S109).

(Offset Mode for Stacking a Sheet on the Ascending and Descending Tray 53 in an Offset Manner Without Subjecting the Sheet to Stapling Treatment)

When an operator selects a mode for performing offset treatment without performing the stapling treatment, a sheet is guided to the post-treatment portion 60 by the sheet guide path 52*d* and the guide rib 52*e* in the state shown in FIG. 3.

The post-treatment portion 60 pivots a swing guide 61 from a position indicated by the broken line to a position indicated by the solid line to separate and open the delivery roller pair 62, whereby a plurality of sheets can be stacked on a treatment tray 66. The sheet is stacked on the treatment tray 66 and is pulled back in a direction indicated by the arrow A on the treatment tray 66 by a knurled belt 63 rotating in the direction indicated by the arrow A.

The sheet is hit against a rear end alignment reference wall 65*a*, which is integrally formed in a stapler 65 of the post-treatment portion 60 and is aligned at an end (transporting direction) thereof. Then, the sheet is also aligned in front and depth directions (width direction) thereof by a pair of alignment plates arranged in front and the inside across the sheet. When a predetermined number of sheets are stacked on the treatment tray 66, the swing guide 61 returns to the position indicated by broken line, whereby the bundle of sheets are nipped by the delivery roller pair 66 and delivered onto the ascending and descending tray 53 by the rotation of the delivery roller pair 66.

Thereafter, the next bundle of sheets is transported into the post-treatment portion 60. The sheets are stacked on the treatment tray 66 with an alignment position thereof changed by the pair of alignment plates. Then, when the predetermined number of sheets are stacked on the treatment tray 66, the stack of sheets are delivered to the ascending and descending tray 53 in an offset manner by the delivery roller pair 66 (S107, S108). The ascending and descending tray 53 is lowered as the number of stacked sheets increases.

(Sheet Treatment Mode for Stapling Sheets)

When the operator selects a sheet treatment mode, a treatment mode signal is sent to the sheet treatment control portion 69 from the image formation control portion 24. Then, in a state shown in FIG. 3, the stack of sheets stacked on the treatment tray 66 of the post-treatment portion 60 are bound by the staple 65 and, then, delivered to the ascending and descending tray 53 by the delivery roller pair 66 (S107, S109). The ascending and descending tray 53 is lowered as the number of stacked sheets increases.

Note that, for example, a rear end wall. 52*b* serving as a sheet stopping piece for stopping an upstream side of a sheet is formed in an upstream end portion of the pivotable guide 52. When the pivotable guide 52 pivots from the position shown in FIG. 2 to the position shown in FIG. 3 while stacking sheets on the stacking surface 51*a*, the rear end wall 52*b* stops the upper end of the sheets to prevent the sheet from falling from the stacking surface 51*a*. In addition, the rear end wall 52*b* prevents the upstream ends of the sheet from rubbing against the delivery roller pair 22 or the apparatus main body 23 of the copying machine as the pivotable guide 52 rotates, and protects the sheet from damage. Moreover, since the stacking surface 51*b* is formed as a slanted surface with an upstream side end thereof lower than a downstream side end thereof in a sheet delivery direction, the rear end wall 52*b* stops the sheet slipping off this stacking surface 51*b* to align the sheet.

In any of the above-mentioned mode for not subjecting a sheet to the post-treatment, offset mode, and sheet treatment mode, after a job which is instructed to be executed ends (S110), when a sheet is not delivered from the image forming portion 2 for a fixed time, the sheet treatment control portion 69 releases an operation state of the plunger 68, whereby the pivotable guide 52 returns to the waiting position shown in FIG. 2 (S112). Thereafter, the power supply of the sheet treating apparatus is turned off (S113).

Note that, the return spring 70 constituting the drive portion of the pivotable guide is provided such that the pivotable cam 54 surely returns to the waiting position from the actuated position as described above. However, in the case in which the pivotable cam 54 surely returns to the returned position with the aid of the gravitational force of the spindle 68*a* or the like facing a vertical direction of the plunger 68, the return spring 70 is not always necessary. Therefore, the elastic force of the return spring 70 or the gravitational force of the cam 54 may be used to return the pivotable guide 52 to the waiting position.

The judgment processing for judging whether a sheet is not delivered for a fixed time in S111 is performed by the sheet treatment control portion 69 based upon an image formation end signal from the image formation control portion 24. However, this may be judged based upon a time elapsed from the time when a sheet passage detection sensor 26 provided in the sheet guide path 56 detects a sheet for the last time.

In addition, the sheet treating apparatus 50 is adapted such that, when the pivotable guide 52 is in a lifting position shown in FIG. 3, if the power supply of the copying machine 101 or the power supply of the sheet treating apparatus is turned off, the holding current flowing to the plunger 68 stops and the operation state of the plunger 68 is released, and the pivotable cam 54 and the pivotable guide 52 are returned to the waiting position shown in FIG. 2 by the elastic force of the return spring 70.

Figure 9:
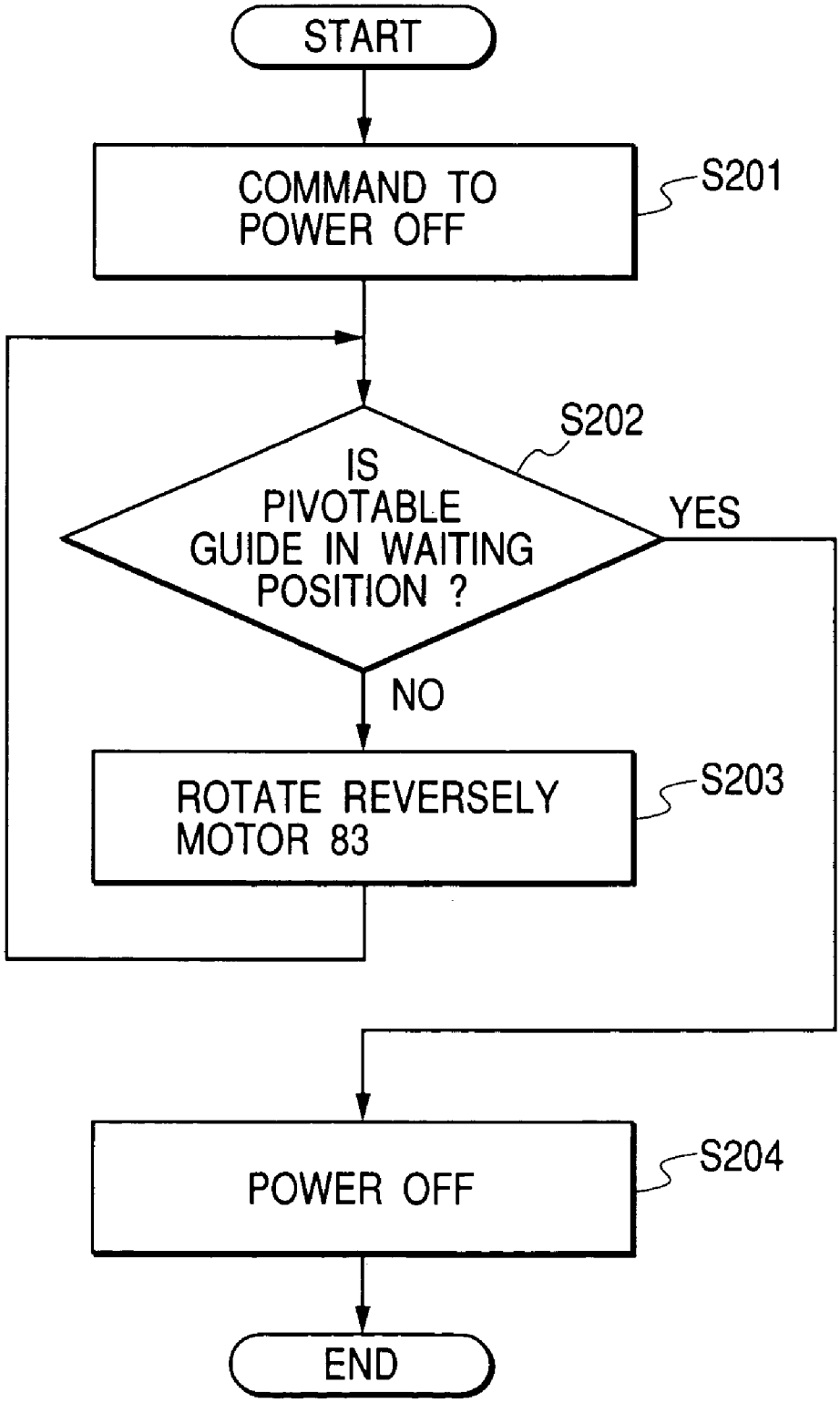
FIG. 9 is a schematic flowchart illustrating operations of the sheet treating apparatus in the case in which a power supply is turned OFF with delay after a turning-off command of the power supply is given.

Note that, as shown in FIG. 6, in the case in which the motor 83 (or the motor 59) is used instead of the plunger, a mechanical or electrical delay switch may be used as the switch 84 for turning off the power supply of the copying machine or a power supply switch for turning off the power supply of the sheet treating apparatus to return the pivotable cam 54 and the pivotable guide 52 to the waiting position during the delay time as shown in the flowchart of FIG. 9. That is, the pivotable cam 54 and the pivotable guide 52 may be returned to the waiting position shown in FIG. 2 by reversely rotating the motor 83 (or the motor 59) (S203)

until a predetermined time required for the pivotable guide 52 returning to the waiting position shown in FIG. 2 (S202) after turning-off command of the power supply is given (S201), and turning off the power supply (S204) after the predetermined time has elapsed.

In addition, in a structure in which, after the pivotable guide 52 is pivoted to the actuated position of FIG. 3 by the motor 83 (or the motor 59), the pivotable guide 52 is returned to the waiting position by the gravitational force of the pivotable guide 52, it is unnecessary to use the delay switch. Moreover, in a structure in which, after the pivotable cam 54 is directly pivoted to the actuated position of FIG. 3 by the motor 83 (or the motor 59), the pivotable cam 54 is returned to the waiting position by the gravitational force of the pivotable cam 54, it is unnecessary to use the delay switch. That is, by turning off the power supply, since the locking current flowing to the motor 83 (or the motor 59) stops, the locked state of the motor 83 (or the motor 59) is released, and the motor 83 (or the motor 59) comes into a rotatable state, the pivotable guide 52 can return to the waiting position with the aid of the gravitational force of the pivotable guide 52. If a sheet is transported to the sheet treating apparatus 50 within a fixed time in S111, the sheet treating apparatus 50 proceeds to the next job (S116).

As described above, the sheet treating apparatus 50 guides a transported sheet to the stapler 65 of the post-treatment portion 60 using the sheet guide path 52*d* when the pivotable guide 52 is in the position shown in FIG. 3 and, on the other hand, the sheet treating apparatus 50 stops the sheet with the fixed tray 51 when the pivotable guide 52 is in the position shown in FIG. 2. Thus, the sheet treating apparatus 50 can stop a sheet which is not required to be subjected to the post-treatment with the fixed tray 51 without transporting the sheet to the post-treatment portion 60, and can stop a sheet transported from the image forming apparatus without performing any operation such as an initialization operation of the sheet treating apparatus. Therefore, energy saving can be realized. In addition, it becomes unnecessary to actuate the post-treatment portion 60 needlessly and abrasion and failure are reduced so much more for that, and durability of the sheet treating apparatus 50 is improved. Further, since the sheet treating apparatus 50 does not pass a sheet which is not subjected to the post-treatment through the post-treatment portion 60, it becomes less likely that a sheet is smeared or damaged. In addition, quality of the sheet or quality of an image formed on the sheet is never decreased.

Moreover, the copying machine 101 having the sheet treating apparatus 50, which does not perform the initialization operation needlessly in this way, as a part of components can reduce time for staring an image forming operation.

In addition, the position in which the pivotable guide 52 is lowered shown in FIG. 2 is set as a waiting state (initial state), so that even in the case in which the sheet treating apparatus 50 is stopped and does not operate due to an occurrence of some deficiency or the sheet treating apparatus 50 itself during actuation cannot be operated, a sheet can be delivered onto the fixed tray 51.

In the above-mentioned sheet treating apparatus, the pivotable guide 52 is pivoted by the pivotable cam 54 which is pivoted by the plunger 68, the motor 83, or the like. However, the pivotable guide 52 may be directly pivoted by the plunger or the motor without using the pivotable cam 54. Therefore, the pivotable cam 54 is not always necessary.

(Sheet Treating Apparatus of a Second Embodiment)

Figure 7:
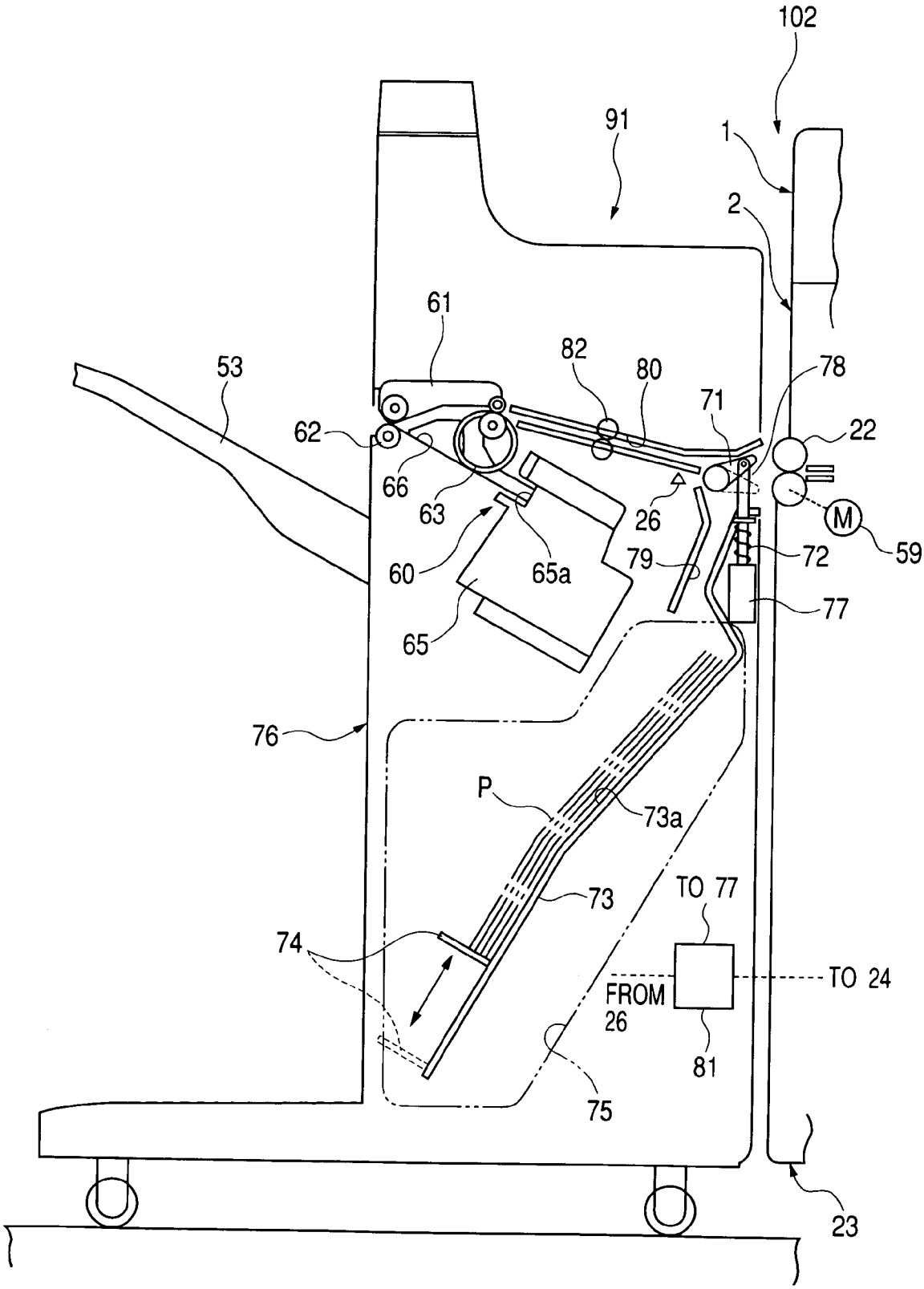
FIG. 7 is a sectional view along a sheet transporting direction of a sheet treating apparatus of a second embodiment.

The sheet treating apparatus 50 of the first embodiment described above is provided with the fixed tray 51, on which sheets that have not been subjected to the post-treatment are stacked, above the ascending and descending tray 53 and the post-treatment portion 60. However, a sheet treating apparatus 91 of a second embodiment shown in FIG. 7 is provided with, for example, a fixed tray 73 serving as sheet stacking means below the ascending and descending tray 53 and the post-treatment portion 60. In the sheet treating apparatus 91 of the second embodiment, parts identical with those of the sheet treating apparatus 50 of the first embodiment are denoted by the identical reference symbols, and descriptions of the parts are omitted. In addition, since the control operations are also the same, a part of descriptions thereof will be omitted.

In the sheet treating apparatus 91 of the second embodiment, an apparatus main body 76 of the sheet treating apparatus 91 and the apparatus main body 23 of the image forming portion 2 or the like are separately provided as in the first embodiment shown in FIG. 1. In addition, a sheet treatment control portion 81 may be integrated with the image formation control portion 24 as in the sheet treating apparatus of the first embodiment shown in FIG. 4. Alternatively, although not illustrated, the image formation control portion 24 may be integrated with the sheet treatment control portion 81. Moreover, as in the sheet treating apparatus of the first embodiment shown in FIG. 5, the sheet treating apparatus 91 and the image forming portion 2 or the like may have a common apparatus main body, and the sheet treatment control portion 81 and the image formation control portion 24 may be integrated.

A flapper 71 serving as a displacement body is provided in a sheet entrance 78 of the apparatus main body 76 of the sheet treating apparatus 91 so as to be pivotable in a vertical direction. The entrance 78 is opposed to the delivery roller pair 22. The flapper 71 selects a delivery transport path 79 which guides a sheet to the fixed tray 73 and a treatment guide path 80 which guide the sheet to the post-treatment portion 60. When the sheet treating apparatus 91 is not used, the flapper 71 held in a waiting position indicated by the solid line by a spring 72 serving as biasing means such that sheets are stacked on the fixed tray 73. Note that the flapper 71 may be rotated by a motor in the apparatus main body 76. Moreover, the flapper 71 may be rotated by the motor 59 which rotates the delivery roller pair 22 shown in FIG. 7.

When the flapper 71 is in the waiting position indicated by the solid line, a sheet delivered form the delivery roller pair 22 is guided to the delivery transport path 79, and slips off a stacking surface 73*a* of the fixed tray 73 formed in a steep slope with the aid of its gravitational force to be stopped by a leading edge hitting member 74 and stacked on the fixed tray 73. The leading edge hitting member 74 can move vertically in a direction indicated by the arrow to adjust its position according to a size of a sheet. An opening portion 75 for taking out a sheet stacked on the fixed tray 73 is formed on a front surface of the apparatus main body 76 of the sheet treating apparatus 91.

In the case in which a sheet is subjected to staple treatment, when a plunger 77 operates against the spring 72, the flapper 71 pivots from the position indicated by the solid line to a position indicated by the broken line to guide the sheet to the treatment guide path 80. The sheet guided from the delivery roller pair 22 to the treatment guide path 80 is guided by a transporting roller pair 82 to be stacked on the treatment tray 66 of the post-treatment portion 60. When a plurality of sheets are stacked on the treatment tray 66 in a bundle, the stapler 65 operates to bind the bundle of sheets. Finally, the sheet is delivered to and stacked on the ascending and descending tray 53. The ascending and descending tray 53 is lowered according to the number of sheets to be stacked such that the delivery roller pair 62 is not blocked by the stacked sheets.

Guide selection means includes, for example, the flapper 71 and the plunger 77. Alternatively, the guide selection means includes the flapper 71 and the motor.

As a structure of the drive portion, for example, mechanisms such as the plunger 77 and the spring 72, the motor 83, and the motor 59 are included.

As in the first embodiment, the sheet treating apparatus 91 of the second embodiment described above also guides a transported sheet to the post-treatment portion 60 when the flapper 71 is in the position indicated by the broken line and guides the sheet to the fixed tray 73 when the flapper 71 is in the position indicated by the solid line. Therefore, the sheet treating apparatus 91 can stop a sheet, which is not required to be subjected to the post-treatment, in the fixed tray 73 without transporting the sheet to the post-treatment portion 60. Thus, the sheet treating apparatus 91 can stop the sheet in the fixed tray 73 without performing any operation such as the initialization operation of the sheet treating apparatus, whereby energy saving can be realized. In addition, it becomes unnecessary to actuate the post-treatment portion 60 needlessly and abrasion and failure are reduced so much more for that, and the sheet treating apparatus 91 can be used for a long time period.

Note that when energization to the plunger 77 is cut off, the flapper 71 selects the fixed tray 73. In addition, when the flapper 71 is in the position indicated by the broken line and a sheet, which is expected to be delivered from the image forming portion 2 of the copying machine 102, is not delivered when a predetermined time has elapsed, energization to the plunger 77 is cut off and returned to the waiting state indicated by the solid line by the spring 72. In accordance with this, the flapper 71 also returns to the waiting position indicated by the solid line, and the power supply of the sheet treating apparatus is turned off. In addition, when the power supply of the copying machine 102 or the power supply of the sheet treating apparatus is turned off, in the case in which the flapper 71 is in the position indicated by the broken line, energization to the plunger 77 is cut off, and the flapper 71 is rotated to the position indicated by the solid line by the spring 72 to return to the waiting state.

The judgment on whether a sheet is not delivered for a fixed time is performed by the sheet treatment control portion 81 based upon an image formation end signal from the image formation control portion 24. However, this may be judged based upon a time elapsed from the time when a sheet passage detection sensor 26 provided in the sheet guide path 80 detects a sheet for the last time.

As described above, the state in which the flapper 71 is held in a position indicated by the solid line of FIG. 7 by the spring 72 is set as an initial state, so that even in the case in which the sheet treating apparatus 91 is stopped and does not operate due to an occurrence of some deficiency or the sheet treating apparatus 91 itself during actuation cannot be operated, a sheet can be delivered onto the fixed tray 73.

Note that, in a structure in which the motor 59 is used instead of the plunger, a mechanical or electrical delay switch may be used as the switch 84 for turning off the power supply of the copying machine or a power supply switch for turning off the power supply of the sheet treating apparatus to return the pivotable cam 54 and the pivotable guide 52 to the waiting position during the delay time. That is, the flapper 71 may be returned to the waiting position by setting the power supply to be turned off when a predetermined time has elapsed after turning-off command of the power supply is given to reversely rotate the motor 59 within the predetermined time.

The present invention is not limited to the above-mentioned embodiments, and various modifications are possible within the scope indicated in claims.

What is claimed is:

1. A sheet treating apparatus for subjecting a sheet transported from an image forming apparatus to treatment, comprising:

a sheet stacking portion which is arranged to stack a sheet ejected from the image forming apparatus, said sheet stacking portion being without an independent transporting drive force for transporting said sheet;

a sheet treating portion which is arranged to subject the sheet transported from the image forming apparatus to a post-treatment;

a sheet guiding portion which is arranged to selectively guide the sheet transported from the image forming apparatus to one of said sheet stacking portion and said sheet treating portion, wherein said sheet guiding portion comprises:

a displacement body which can be displaced between a first position for guiding the sheet to said sheet stacking portion and a second position for guiding the sheet to said sheet treating portion;

a drive portion which displaces said displacement body from the first position for guiding the sheet to said sheet stacking portion to the second position for guiding the sheet to said sheet treating portion; and a power supply activated biasing portion which, when said displacement body is in the position for guiding the sheet to said sheet treating portion and a power supply is turned off, biases said displacement body to be in the position for guiding the sheet to said sheet stacking portion; and a sheet treatment control portion which controls the sheet treating apparatus;

wherein said sheet treating control portion arranges said sheet guiding portion to be in the first position to guide the sheet to said sheet stacking portion in a state in which the power supply of said sheet treating apparatus is turned off.

2. A sheet treating apparatus according to claim 1, wherein the sheet stacking portion is positioned at an elevation below that at which the sheet is ejected from the image forming apparatus.

3. A sheet treating apparatus according to claim 1, wherein said sheet treatment control portion arranges said sheet guiding portion to be switched to a state of selecting said sheet stacking portion when the sheet is not transported for a predetermined period of time in the state in which said sheet guiding portion is selected to guide the sheet to said sheet treating portion.

4. A sheet treating apparatus according to claim 1, wherein when the power supply to said sheet treating apparatus is activated, said displacement body is urged upward by the drive portion to the second position for guiding the sheet to said sheet treating portion and when the power supply is turned off, said displacement body is displaced by a gravitational force of said displacement body and is not urged upward, leaving said displacement body at the first position for guiding the sheet to said sheet stacking portion.

5. A sheet treating apparatus according to claim 4, wherein said displacement body comprises a sheet guide path which guides the sheet to said sheet treating portion.

6. A sheet treating apparatus according to claim 1, wherein said sheet treating portion has one of a function for aligning sheets, a function for punching sheets, and a function for stapling sheets.

7. A sheet treating apparatus according to claim 1, wherein the second position is higher than the first position.

* * * * *

UNITED STATES PATENT AND TRADEMARK OFFICE

CERTIFICATE OF CORRECTION

PATENT NO. : 7,207,559 B2
APPLICATION NO. : 10/628430
DATED : April 24, 2007
INVENTOR(S) : Yoshimi Mizuta et al.

It is certified that error appears in the above-identified patent and that said Letters Patent is hereby corrected as shown below:

COLUMN 8:
Line 3, "wall." should read --wall--.

COLUMN 9:
Line 50, "staring" should read --starting--.

COLUMN 10:
Line 36, "guide" should read --guides--.

Signed and Sealed this

Fourth Day of March, 2008

JON W. DUDAS
*Director of the United States Patent and Trademark Office*